US011332347B2

(12) United States Patent
Richardson

(10) Patent No.: US 11,332,347 B2
(45) Date of Patent: May 17, 2022

(54) VARIABLE LENGTH TACKLE SLING

(71) Applicant: Richardson Capax, LLC, Beaumont, TX (US)

(72) Inventor: Christopher L. Richardson, Beaumont, TX (US)

(73) Assignee: Richardson Capax, LLC, Beaumont, TX (US)

( * ) Notice: Subject to any disclaimer, the term of this patent is extended or adjusted under 35 U.S.C. 154(b) by 323 days.

(21) Appl. No.: 16/363,993

(22) Filed: Mar. 25, 2019

(65) Prior Publication Data

US 2019/0292021 A1 Sep. 26, 2019

Related U.S. Application Data

(60) Provisional application No. 62/648,236, filed on Mar. 26, 2018.

(51) Int. Cl.

| | |
|---|---|
| ***B66C 1/12*** | (2006.01) |
| ***B66D 1/74*** | (2006.01) |
| ***B66D 3/04*** | (2006.01) |

(52) U.S. Cl.

CPC ..... *B66C 1/12* (2013.01); *B66D 1/741* (2013.01); *B66D 3/04* (2013.01)

(58) Field of Classification Search

CPC ..... B66C 1/12; B66C 1/122; B66C 1/125; B66C 1/127; B66C 1/14; B66C 1/16; B66C 1/18; B66D 3/04; B66D 3/043; B66D 3/12

See application file for complete search history.

(56) References Cited

U.S. PATENT DOCUMENTS

| | | | | | |
|---|---|---|---|---|---|
| 22,008 | A | * | 11/1858 | Barr | B66D 1/26 254/286 |
| 484,038 | A | * | 10/1892 | Morgan | B66D 3/06 254/399 |
| 516,098 | A | * | 3/1894 | Kleritj | B66D 1/26 254/285 |
| 694,244 | A | * | 2/1902 | Bradshaw | B66C 3/12 37/184 |
| 838,025 | A | * | 12/1906 | Henry | B66C 21/00 212/313 |
| 1,177,767 | A | * | 4/1916 | Eggleston | B66C 13/02 254/337 |
| 2,052,074 | A | * | 8/1936 | Black | B66D 3/06 254/393 |
| 2,315,985 | A | * | 4/1943 | Schwartz | B66C 3/125 212/81 |
| 2,489,022 | A | * | 11/1949 | Franks | B66D 3/14 254/336 |
| 2,524,351 | A | * | 10/1950 | Jensen | B66D 1/04 254/343 |
| 2,678,191 | A | * | 5/1954 | Jensen | B66D 3/12 254/330 |
| 2,960,310 | A | * | 11/1960 | Hull | B66D 3/043 254/337 |
| 3,226,090 | A | * | 12/1965 | Sauerbrey | B66D 1/36 254/284 |

(Continued)

FOREIGN PATENT DOCUMENTS

| | | | | | |
|---|---|---|---|---|---|
| GB | 191128215 | A | * | 1/1913 | B66D 3/12 |

*Primary Examiner* — Michael E Gallion

(57) ABSTRACT

Apparatus for adjusting the length of a support sling includes a set of pulleys and may be useful, for example, to allow a moving device to keep an object level when being transported.

16 Claims, 7 Drawing Sheets

(56) References Cited

U.S. PATENT DOCUMENTS

| | | | | | |
|---|---|---|---|---|---|
| 3,253,851 | A * | 5/1966 | Gilbert | B66C 1/12 | 294/119.2 |
| 4,084,794 | A * | 4/1978 | Wallace | B66D 3/043 | 254/399 |
| 4,767,099 | A * | 8/1988 | Munks | A61D 3/00 | 119/725 |
| 4,770,394 | A * | 9/1988 | Yang | B66C 1/36 | 116/212 |
| 5,816,565 | A * | 10/1998 | McGuffin | B66D 3/04 | 254/386 |
| 9,617,128 | B2 * | 4/2017 | Maurice | B66D 3/02 | |
| 10,239,437 | B2 * | 3/2019 | Thompson | B60P 7/0838 | |
| 2006/0079357 | A1 * | 4/2006 | Bowman | B66D 3/06 | 474/64 |
| 2013/0099186 | A1 * | 4/2013 | Kommer | B66D 3/10 | 254/391 |
| 2019/0031474 | A1 * | 1/2019 | Stilborn | B66C 13/16 | |

* cited by examiner

VARIABLE LENGTH TACKLE SLING

PRIORITY/CROSS REFERENCE TO RELATED APPLICATION

This non-provisional application claims priority to Provisional Patent Application number U.S. 62/648,236 entitled "Variable Length Tackle Sling" filed by Christopher L. Richardson on Mar. 26, 2018. That application is incorporated by reference in its entirety.

BACKGROUND OF THE INVENTION

When a crane moves an object, a commonly used mechanism to couple the object to the crane is a sling. A sling has one end attached to a fixed point on the object with the opposite end attached to a crane hook. It is a well-known concept that when a crane lifts an object, the crane hook will always be above the object's center of gravity. With regular objects with equal weight distribution, this is not an issue as the crane hook will lift above the center of the object and the object will remain level. A common example of an object would be a container. An example would be a portable building based on an intermodal container. However, many objects moved by cranes have irregular weight distributions. One end of the container may contain HVAC or other equipment that is not matched by equipment of equal weight at some point on the opposite end. As a result, the crane hook will be over an area offset from the physical middle of the container, making the container more difficult to transport safely as the container will not stay level.

While the weight distribution may be subject to an infinite number of variables, the locations of the attachment points where slings may attach are fixed based on container design. With the location of the crane hook and the container attachment points being fixed, the prevailing method of making sure the container stays level as the crane hook comes over the center of gravity is to use spreader bars and slings of various lengths to cause the container to remain level.

Slings typically come in predetermined lengths. The sling lengths necessary to properly lift an object typically are not the same length as these predetermined slings. As a result, devices have been used to alter the length of these slings. One example is a turnbuckle, which attaches to the end of a sling to grant it some additional length. The major limitation with turn buckles is that they are very limited in the amount of length they can add, usually adjustments of approximately one foot. These turnbuckles typically do not have a sufficient adjustment length and limits on the loads they can support. Link plates may also be used so that the slings can be adjusted to reach the appropriate length. Additionally, spreader bars may be used to further impact the geometry of the slings used to lift the object.

Another mechanism used to transport a container and remain level include a frame that is suspended over the object where hydraulically operated extensions move to the desired length to attach to the object. However, those mechanisms require bulky hydraulic equipment and may fail with little warning.

As a result, there is a need in the industry for a sling that may change lengths to a degree not currently available to allow for ease of use when moving an object by crane.

SUMMARY

The disclosed invention in an exemplary embodiment involves the use of two or more pulleys linked to create a variable length sling. A pair of pulleys are used in series that are connected by a rope. The first pulley is connected to a hook or a fixed length sling. The second pulley is connected to the object to be transported or a fixed length sling. The rope deploys or retracts until the variable length sling reaches the desired length. When the hook rises, the location of the hook is impacted by the tension created in the various fixed length slings and variable length slings. The use of the invention results in the hook being over the center of gravity when the object is lifted while keeping the object level.

The pulleys used comprise a storage spool and a guide wheel spindle with guide wheels. The storage spool holds a rope that passes through the guide wheels for deployment. The pulleys allow the rope to extend to a needed length to adjust the variable length sling.

The disclosed invention in a further exemplary embodiment further comprises a control mechanism for the above disclosed pulley to control the length of the variable length sling. The control mechanism may take many forms. Arresting bars restrict storage spool rotation. Control gears attached to storage spools may impact storage spool rotations when interfaced with tools, such as ratchets or worm drives. Any control system may be used singularly or in concert with other controls.

The disclosed invention in an exemplary embodiment comprises the method of using the variable length slings. By coupling variable length slings to containers and fixed length slings or loading devices, an object may be kept level during transport.

DETAILED DESCRIPTION OF INVENTION

Figure 1A:
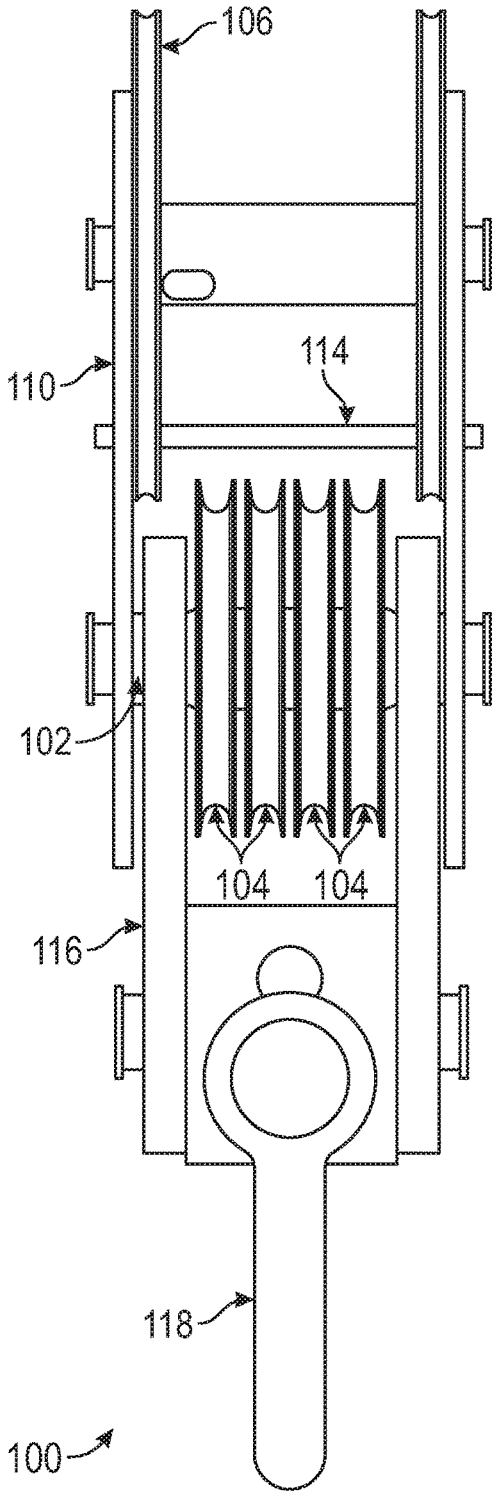
FIG. 1*a* is a diagram of the front view of a pulley in an exemplary embodiment.

The disclosed invention facilitates transportation of objects by crane that are typically transported by a series of fixed length slings 404 connected to a single crane hook 402. Once the center of gravity and connection points of the object are known, the necessary sling lengths to keep the object level may be calculated. The fixed length slings used may be those closest, but not more than, the calculated length. The distal ends and proximal ends of the fixed length slings 404 that are already the correct length are coupled to the container 408 to be moved. Fixed length slings 404 that are not sufficient length are connected to a variable length sling 200. Variable length slings 200 may be connected to the hook 402 and the fixed length sling 404, the fixed length sling 404 and the container 408, or in any configuration that impacts the total length of slings between the hook 402 and the container 408. The result is where the combination of the fixed length sling 404 and variable length sling 200 combine to connect the hook 402 to the container 408.

Figure 1B:
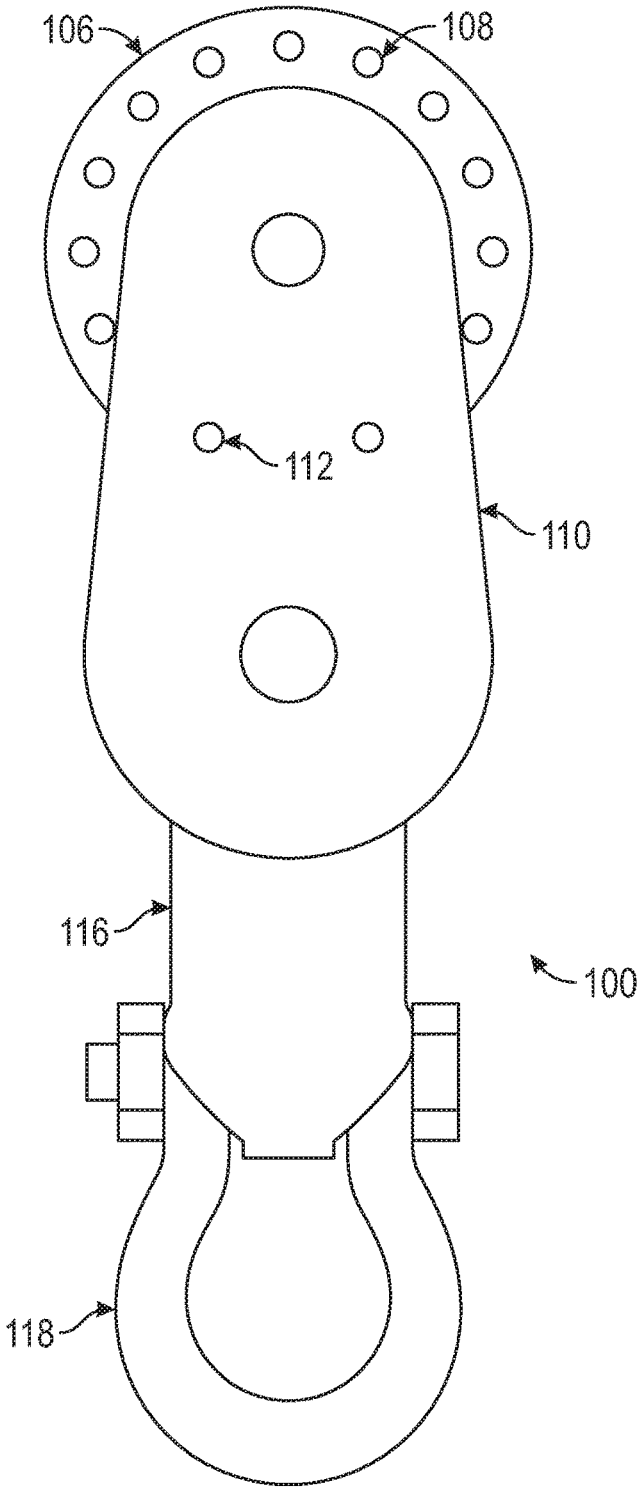
FIG. 1*b* is a diagram of the side view of a pulley in an exemplary embodiment.

An exemplary embodiment of the invention involves a pulley 100 with a storage spool 106, a guide wheel spindle 102, connector plate 110, and a coupler 118 as shown in FIG. 1*a* and 1*b*. The guide wheel spindle 102 is a cyclical element that passes through a plurality of guide wheels 104 dimensioned to accept the rope 218 used in an exemplary embodiment. Attached to the guide wheel spindle 102 is the coupler projections 116 that connects to the coupler 118, where the crane hook 402 or the other fixed length sling 404 may interface with the variable length sling 200. On the opposite end of the guide wheel spindle 102 from the coupler 118 is the storage spool 106, where the rope 218 may be stored in an exemplary embodiment. Connecting these three major elements together are the connector plates 110 that attached to either end of the guide wheel spindle 102 and the storage spool 106. The storage spool 106 and the guide wheel spindle 102 in the exemplary embodiment reside substantially between the connector plates 110, but have ends that extend past the connector plates 110. These elements may be configured in any arrangement that accomplish the same task without departing from the scope of this disclosure.

Rope 218 or an equivalent physical structure is manipulated by the above disclosed pulley 100 in a variable length sling 200. Rope 218 may be anchored to the storage spool 106 that rotates. The rotation of the storage spool 106 may be as loose or as tense as the design allows. The storage spool 106 has a series of storage spool arrest apertures 108. The locations of these storage spool arrest apertures 108 correspond to the location of plate arrest apertures 112 located on the connector plate 110. A restrictor rod 114 may pass through the storage spool arrest apertures 108 and the plate arrest apertures 112 to fix the storage spool 106 so that it does not rotate. This prevents the rope 218 from deploying or withdrawing. If the restrictor rod 114 is removed, the storage spool 106 may rotate freely.

Figure 5A:
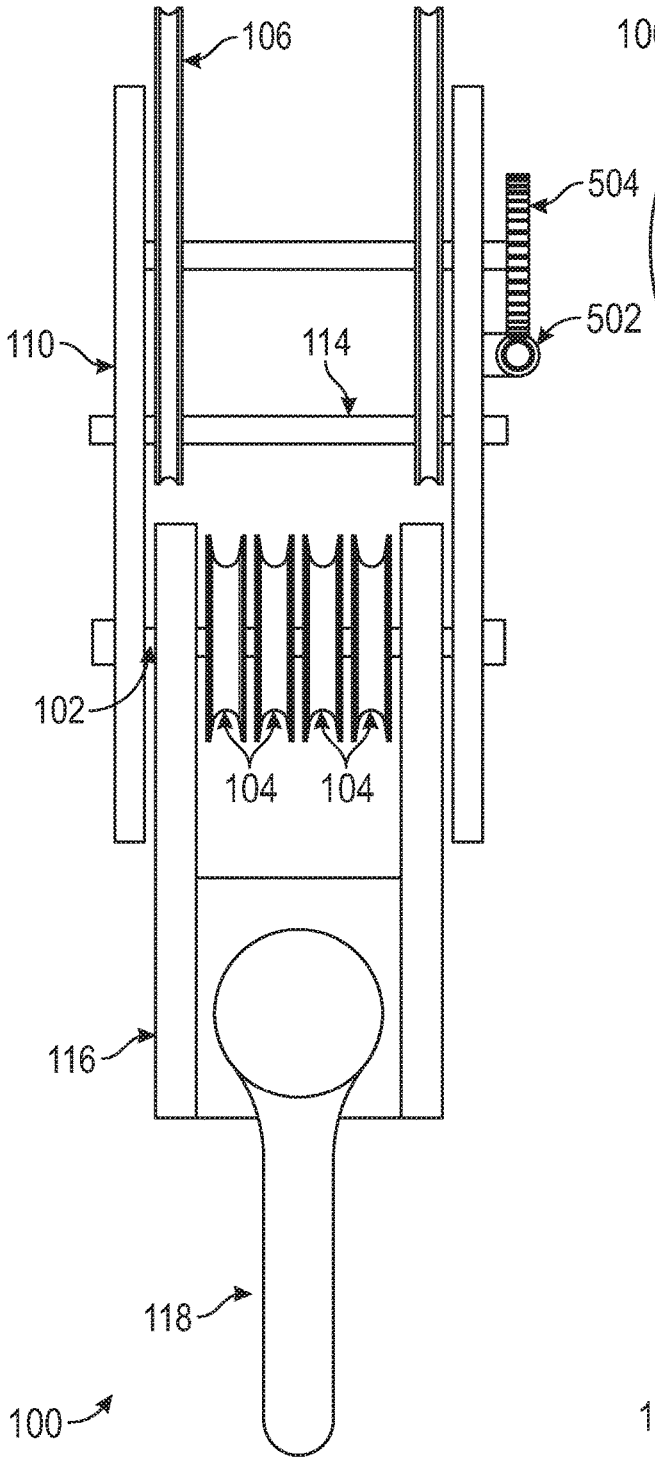
FIG. 5*a* is a diagram of the front view of a pulley in an exemplary embodiment with a worm drive.
Figure 5B:
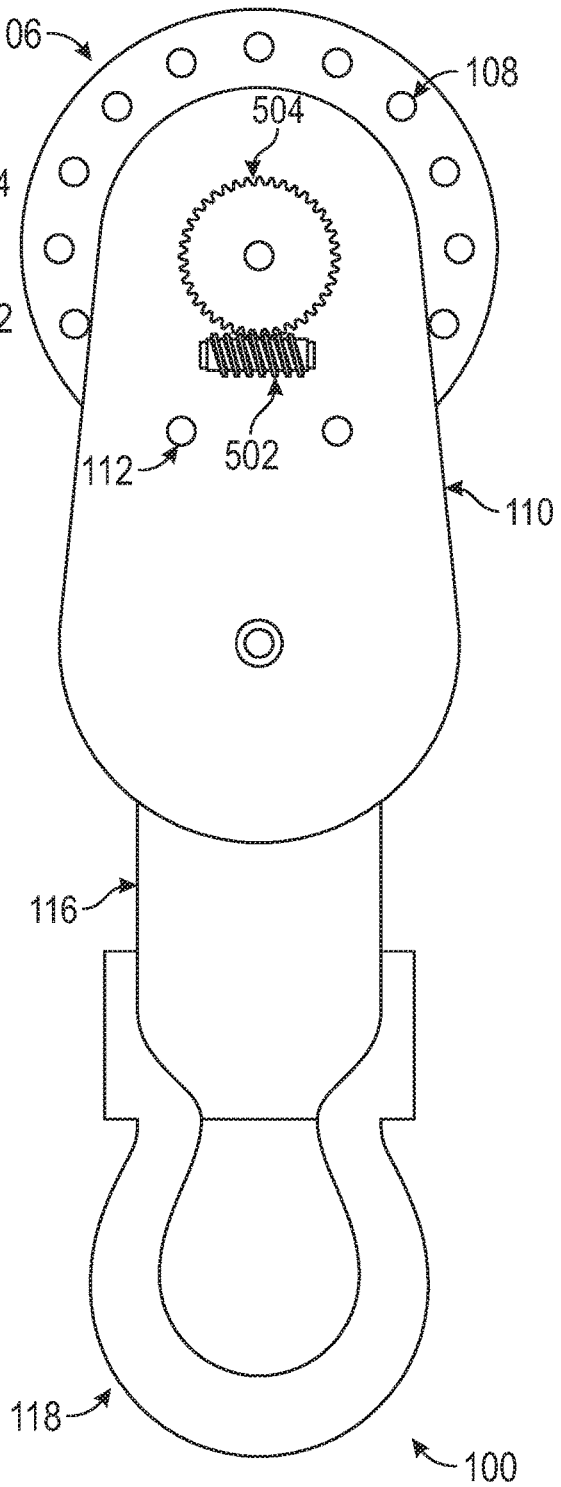
FIG. 5*b* is a diagram of the side view of a pulley in an exemplary embodiment with a worm drive.

In an alternative embodiment, the storage spool 106 may be controlled by any means know to those skilled in the art. One embodiment would include a ratchet that controls the direction of the rope 218 deployment and may assist in the deployment of said rope 218. In a further additional exemplary embodiment in FIGS. 5A and 5B, the pulley 100 incorporates a worm gear 502 and a control gear 504 (forming a worm drive) in communication with the storage spool 106 to control the rope 218. In an exemplary embodiment, the rotation of the worm gear 502 causes the control gear 504 to rotate, which in turn causes the storage spool 106 to rotate and control the length of the rope 218. The worm gear 502 may couple to a tool such that in operator manipulates the tool, which then causes the storage spool 106 to retract or deploy rope 218, causing a corresponding change in the variable length sling 200 length. By using the disclosed embodiment, an operator can rotate the storage spool 106 while under load. Further, the worm gear 502 may be released, allowing the forces acting on the rope 218 to deploy more rope 218 if under tension.

In an alternate exemplary embodiment, the worm gear 502 and the control gear 504 may be located on the inner surface of the connector plate 110 and still function in substantially the same manner. In a further exemplary embodiment, the control gear 504 and worm gear 502 may be embedded in the connector plate 160 and accomplish the same function.

In an exemplary embodiment with the worm gear 502, the variable length sling 200 is coupled to a fixed length sling 404 and a container 408. The storage spool 106 is wound to bring the variable length sling 200 to a tense state. Once the variable length sling 200 is tense, the tool couples to the worm gear 502. The worm gear 502 is then operated to rotate the control gear 504. The storage spool 106 then rotates to draw more tension of the rope 218, shortening the length of the variable length sling 200. Once the variable length sling 200 is at the desired length, the restrictor rod 114 is placed through the plate arrest apertures 112 and the storage spool arrest apertures 108, arresting the storage spool 106 and locking the variable length sling 200 at the desired length. Once the variable length sling 200 needs to be released, the restrictor rod 114 is removed, and the storage spool 106 releases the rope 218.

In the exemplary embodiment, the worm gear 502 may be operated by any means known to those skilled in the art. In an exemplary embodiment, the worm gear 502 causes rotation, but can also lock to prevent rotation of the control gear 504 which in turn controls the storage spool 106. In an alternative embodiment, the worm gear 502 may be allowed to rotate freely, allowing the control gear 504 to allow the storage spool 106 to release. Alternativity, the worm gear 502 may physically disengage from the control gear 504, allowing the storage spool 106 to deploy as needed.

Figure 2A:
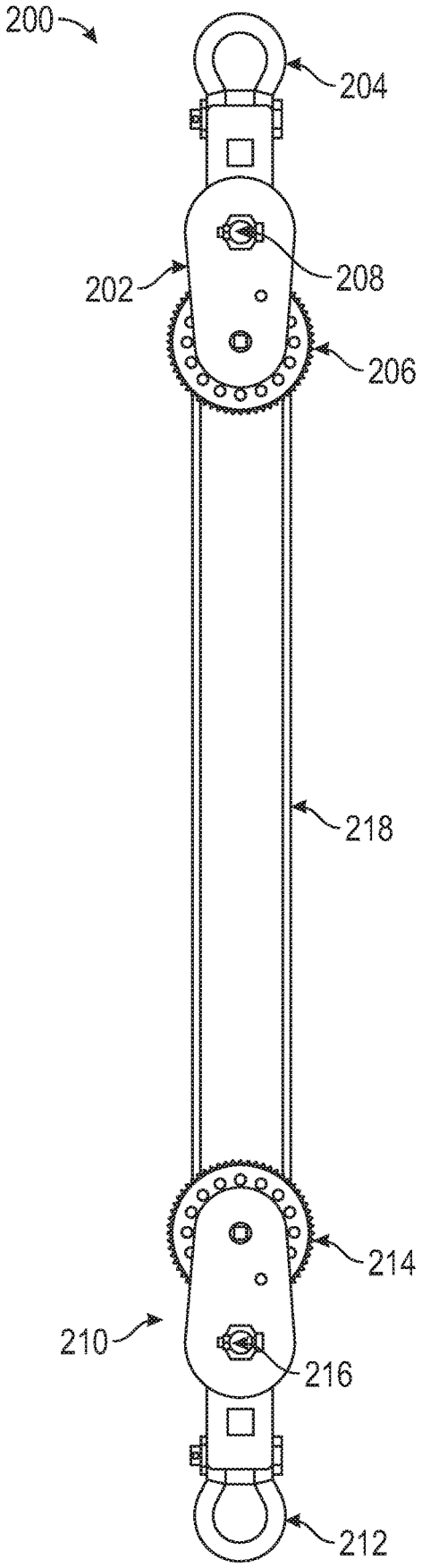
FIG. 2*a* is a diagram of a pulley system in an exemplary embodiment with two pulleys linked to create a variable length sling.
Figure 2B:
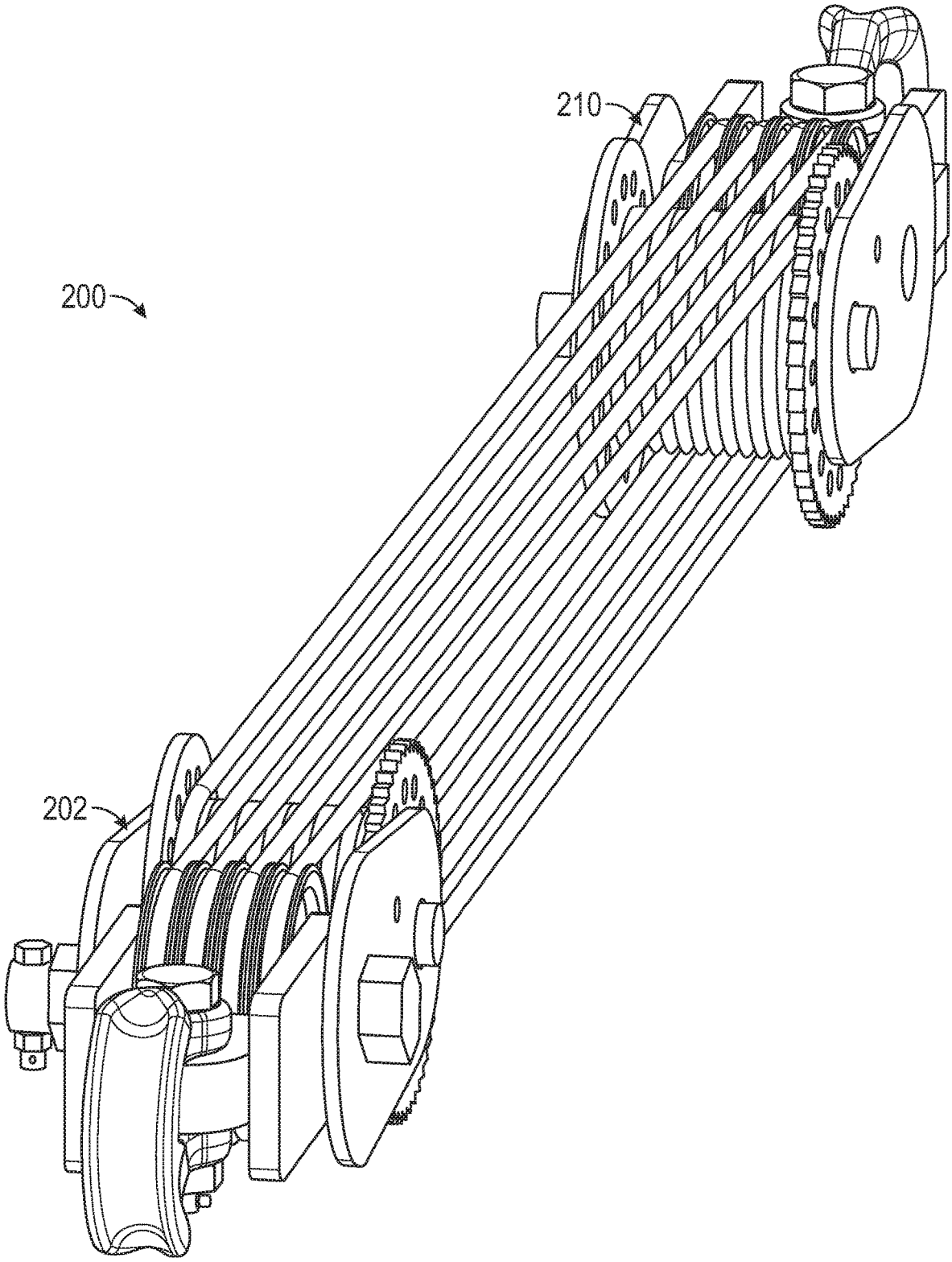
FIG. 2*b* is a prospective view of the pulley system from FIG. 2*a* in an exemplary embodiment.
Figure 3A:
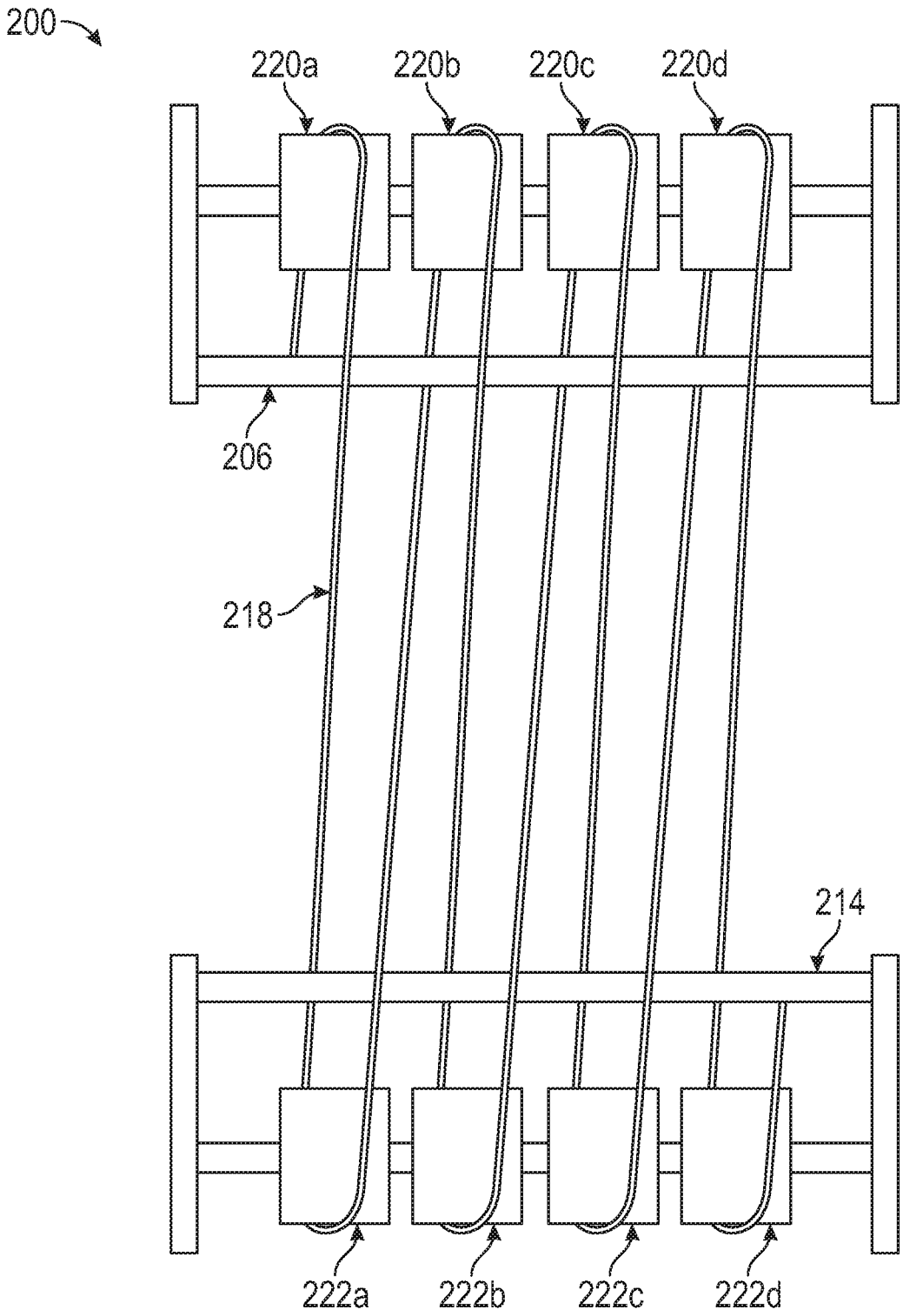
FIG. 3*a* is a diagram of the rope configuration of the pulley system with storage on both pulleys.

An embodiment of the disclosed invention in FIGS. 2*a* and 2*b* involves a series to two pulleys 100 connected in series that attach fixed length slings 404, hooks 402 on cranes, or containers 408 being moved. The crane end pulley 202 and the load end pulley 210 are connected by a rope 218, creating a variable length sling 200. FIG. 3*a* shows a diagram of the rope 218 as it interacts with the variable length sling 200. The rope 218 is fixed to the crane end storage spool 206 where it feeds into first crane end guide wheel 220*a*. From there the rope 218 passes through the first load end guide wheel 222*a*, to the second crane end guide wheel 220*b*, to the second load end guide wheel 222*b*, to the third crane end guide wheel 220*c*, to the third load end guide wheel 222*c*, to the fourth crane end guide wheel 220*d*, to the fourth load end guide wheel 222*d*. Once the rope 218 leaves the fourth load end guide wheel 222*d*, it terminates on a load end storage spool 214. An advantage of the present configuration is that is allows rope 218 to be stored on both the crane end storage spool 206 and the load end storage spool 214, increasing the total amount of rope 218 stored with minimal increase in the size of the exemplary embodiment. The rope 218 feeding off the load end storage spool 214 and the crane end storage spool 206 is controlled by a restrictor rod 114 as shown in FIG. 1. While the exemplary embodiment shows four crane guide end wheels 220 and four load end guide wheels 222, it is understood this number may be adjusted as needed.

In the exemplary embodiment, the variable length sling 200 is adjusted to the length that is necessary for the combined variable length sling 200 and fixed length sling 404 to be at the length necessary to keep the container 408 level per the earlier calculations. Once at the desired length, the crane end pulley 202 and the load end pulley 210 are locked in place with the restrictor rods 114 or other locking mechanism. The process of using variable length slings 200 may be accomplished for as many slings as necessary to have the crane hook 402 over the center of gravity 414 of a container 408 or other object when lifting.

The length of the variable length sling 200 may be of any length based on the rope 218 used. The shortest length may be when the crane end pulley 202 and the load end pulley 210 are in contact due to the rope 218 being at maximum retraction. The longest length may be when the rope 218 is at maximum deployment. The length of the variable length sling 200 is a function of the length of the rope 218 and the number of guide wheels 104 that the rope 218 must pass through. This provides a range of adjustable length not available in current mechanisms. Multiple exemplary embodiments are available with differing lengths of rope 218 available. In some embodiments the rope 218 may be of a length that the variable length sling 200 may have greater extension but might not be able to contract to where the crane end pulley 202 and the load end pulley 210 may come into contact. In an alternate embodiment, the load end storage spool 214 and to the crane end storage spool 206 may be of differing sizes to accommodate different lengths of rope 218.

Figure 3B:
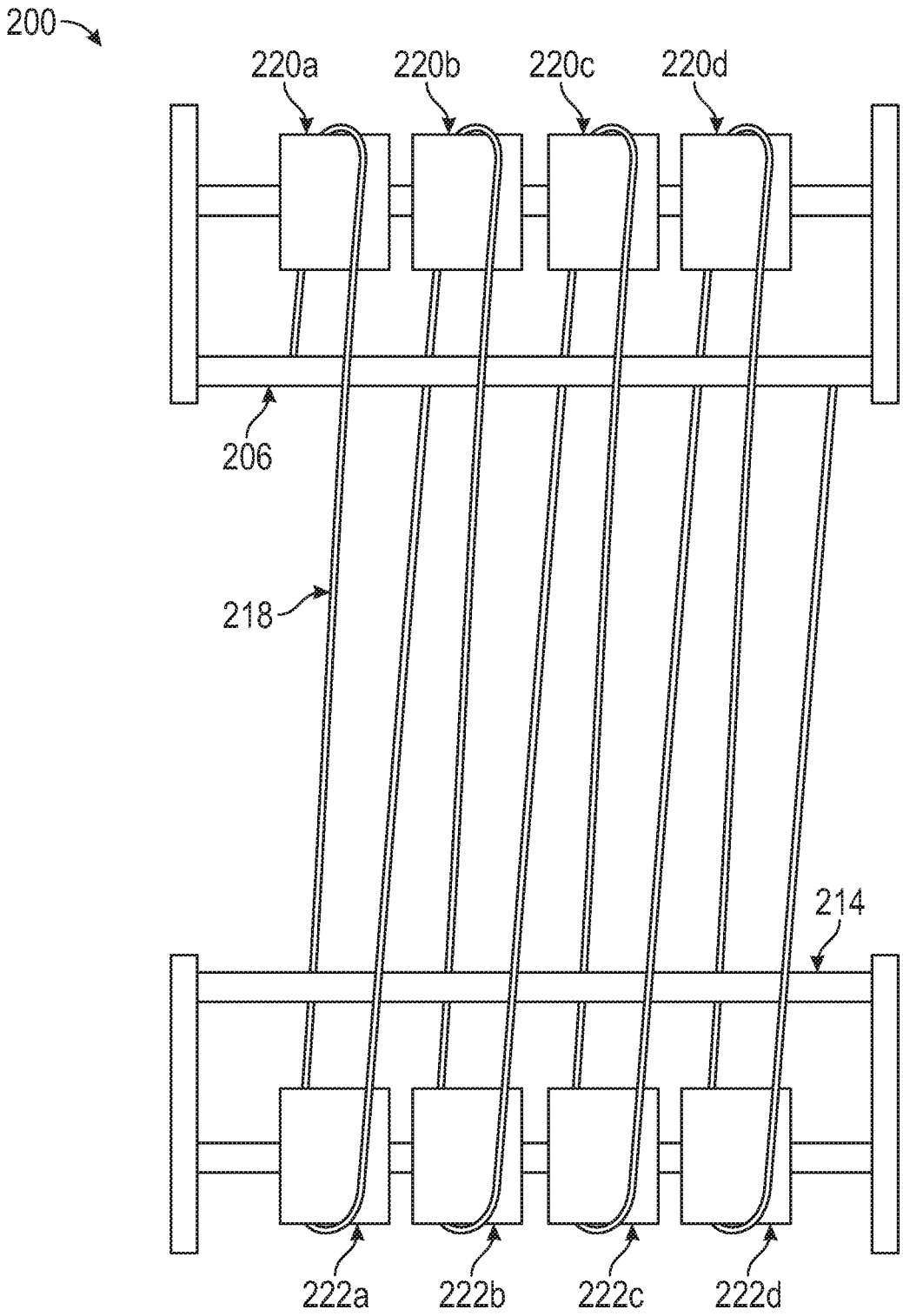
FIG. 3*b* is a diagram of the rope configuration of the pulley system with storage on a single pulley.

Multiple alternative embodiments are available. In an alternative embodiment, the load end pulley 210 system may not attach the rope 218 to a load end storage spool 214, as shown in FIG. 3*b*. In that case, the rope 218 would begin and end at the crane end storage spool 206. In an alternative embodiment, the load end storage spool 214 may be omitted completely. In another embodiment, the use of storage spool arrest apertures 108 may be completely replaced with a control mechanism. These could include, but are not limited to, a ratchet adjustor, a hydraulic adjustor, worm drive, or a pull chain as discussed earlier. In an alternative exemplary embodiment, the coupler 118 may be replaced with a multi sized connector that can adjust to the size needed.

Figure 4A:
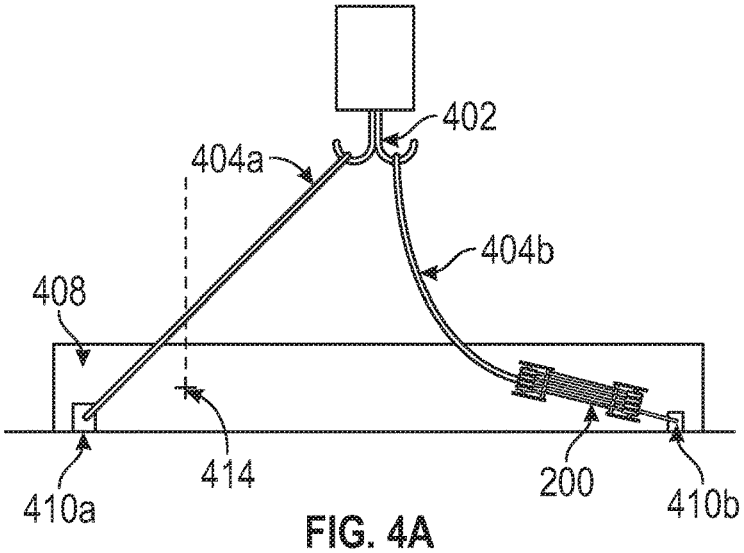
FIG. 4*a* is a diagram of the variable length sling being used on an object with an unequally distributed load with the hook not in tension.
Figure 4B:
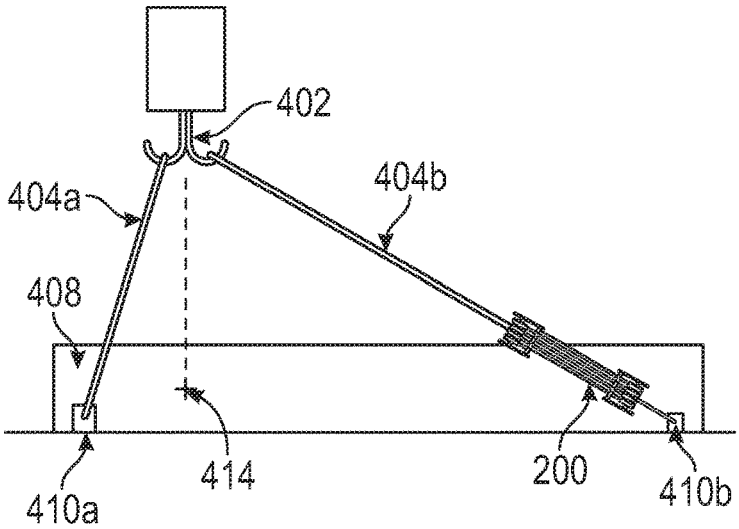
FIG. 4*b* is a diagram of the variable length sling being used on an object with an unequally distributed load with the hook in tension.
Figure 4C:
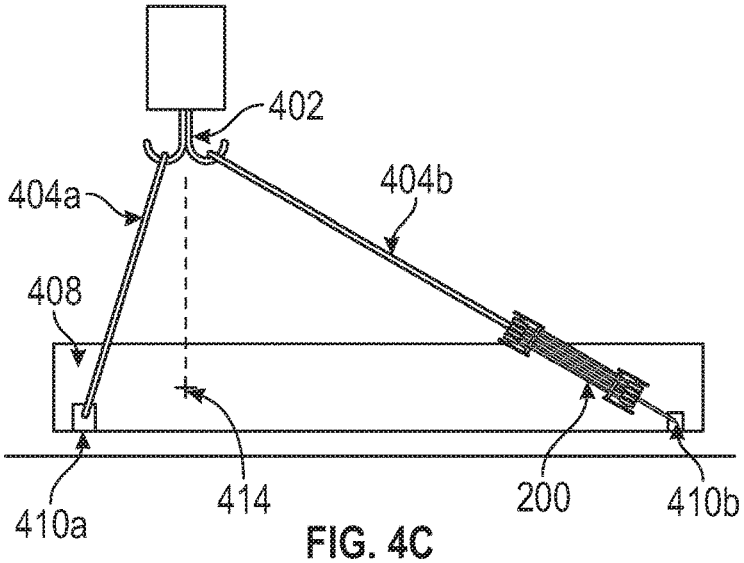
FIG. 4*c* is a diagram of the variable length sling being used on an object with an unequally distributed load with the hook lifting a container.

The disclosed invention may be used to simplify the connections for a hook 402 to an object. For exemplary purposes as shown in FIGS. 4*a*-4*c*, the object to be transported is an intermodal container 408 with connector points 410*a*, 410*b*. These figures are simplified with two dimensions only. In FIG. 4*a*, the hook 402 is loaded over the container 408 with fixed length sling A 404*a* is connected to a connector point 410*a* near the center of gravity 414. Fixed length sling B 404*b* is coupled to the hook 402 and to the variable length sling 200, which in turn is coupled to the connector point 410*b*. The length of fixed length sling B 404*b* and the variable length sling 200 combined are longer than fixed length sling A 404*a*. The length of the variable length sling 200 is adjusted to a length where fixed length sling B 404*b* and the variable length sling 200 are of sufficient length that when the hook 402 rises and creates tension in all slings, the hook 402 will be over the center of gravity 414, keeping the container 408 level. When the hook 402 rises, the various fixed length slings 404 and variable length slings 200 will become taunt when the hook 402 reaches different heights. As the slings get taunt, they will start to pull the hook 402 to where the taunt slings remain taunt but continue to increase the tension of the slings that are not yet taunt. When the variable length slings 200 are properly deployed, the hook 402 will be over the center of gravity 414 as all the when fixed length slings 404*a* and the combined fixed length sling 404*b* and variable length sling 200 are in tension. At that point, the container 408 may be lifted while keeping the hook 402 over the center of gravity 414.

There are multiple alternative embodiments that are within the scope of this invention. For example, multiple pulleys 100 may be used in parallel to create a variable length sling 200. In an alternative embodiment, there may be one than one rope 218 used. In an additional alternative embodiment, there may be a different number of guide wheels 104 used.

While the above disclosed embodiments have been used in regard to slings for use in moving containers, it is understood that this technology may be adapted to other fields while remaining within the scope of this disclosure.

One of skill in the art will appreciate that embodiments provide improved slings for the transportation of objects by crane. Although specific embodiments are illustrated and described herein, it will be appreciated by those of ordinary skill in the art that any arrangement which is calculated to achieve the same purpose can be substituted for the specific embodiments shown. This specification is intended to cover any adaptations or variations of embodiments. In particular, one of skill in the art will appreciate that the names and terminology are not intended to limit embodiments. Furthermore, additional apparatus can be added to the components, functions can be rearranged among components, and new components corresponding to future enhancements and future physical devices used in embodiments can be introduced without departing from the scope of the invention. The terminology used in this application is intended to include all embodiments and alternatives which provide the same functionality as described herein.

The invention claimed is:

1. Apparatus for adjusting the length of a support sling, the apparatus comprising:

a guide wheel spindle;

at least one guide wheel on said guide wheel spindle;

a storage spool having at least one storage spool arrest aperture;

at least one spindle coupler having at least one coupler arrest aperture;

an arresting device insertable into at least one said storage spool arrest aperture and at least one said coupler arrest aperture;

at least one coupler projection connected to said at least one spindle coupler; and a coupler connected to said at least one coupler projection, wherein said storage spool may be rotated to align said coupler arrest aperture and said storage spool arrest aperture, further wherein said storage spool is prevented from rotating when said arresting device is inserted into said at least one storage spool arrest aperture and said at least one coupler arrest aperture.

2. The apparatus of claim 1 wherein said at least one spindle coupler includes at least one connector plate connecting said guide wheel spindle and said storage spool.

3. The apparatus of claim 1 further including a ratchet connected to said storage spool.

4. The apparatus of claim 1 further including a storage spool control gear coupled to said storage spool and a controller thereof.

5. The apparatus of claim 4 wherein said controller allows at least one among said storage spool gear to turn said storage spool in a first direction and said storage spool gear to turn said storage spool in a second direction.

6. The apparatus of claim 4 wherein said controller allows at least one among locking said storage spool gear to prevent turning of said storage spool and releasing said storage spool gear to allow free rotation of said storage spool.

7. The apparatus of claim 4 wherein said controller includes a worm drive.

8. The apparatus of claim 1 further including a rope coupled to said storage spool and in contact with said at least one guide wheel.

9. The apparatus of claim 1 wherein said arresting device includes at least one restrictor rod.

10. A system for providing a variable length sling, the system comprising:

a crane end connector capable of coupling to a sling or lifting mechanism;

a crane end pulley coupled to said crane end connector;

a load end connector capable of coupling to a sling or an object to transport;

a load end pulley connected to said load end connector;

a rope in contact with said crane end pulley and said load end pulley; and a rope length control mechanism coupled to said crane end pulley or said load end pulley, wherein said crane end pulley includes a crane end storage spool coupled to said rope, a crane end guide wheel spindle, at least one crane end guide wheel circumscribing said crane end guide wheel spindle, a crane end spindle connector capable of coupling said crane end storage spool to said crane end guide wheel spindle, and a crane end connecter coupler capable of coupling said crane end spindle connector to a movement device or additional sling.

11. The system of claim 10 wherein said crane end storage spool includes at least one crane end spindle arresting aperture and said crane end spindle connector includes at least one crane end connector plate arresting aperture, whereby a restrictor rod can pass through said at least one crane end spindle arresting aperture and said at least one crane end connector arresting aperture.

12. The system of claim 10 wherein said load end pulley includes a load end storage spool coupled to said rope, a load end guide wheel spindle, at least one load end guide wheel circumscribing said load end guide wheel spindle, a load end spindle connector configured to couple said load end storage spool to said load end guide wheel spindle, and a load end connecter coupler configured to couple to said load end spindle connector to the object or a second additional sling.

13. The system of claim 10 wherein said load end storage spool includes at least one load end spindle arresting aperture and said load end spindle connector includes at least one load end connector plate arresting aperture, whereby an arresting bar can pass through said at least one load end spindle arresting aperture and said at least one load end connector arresting aperture.

14. The system of claim 13 wherein said rope is coupled to said crane end storage spool and said load end storage spool.

15. The system of claim 10 wherein said rope length control mechanism includes at least one among a ratchet, pull chain and worm drive.

16. The system of claim 10 wherein said rope length control mechanism includes a storage spool control gear coupled to said storage spool.

* * * * *